US007719346B2

(12) United States Patent
Imura

(10) Patent No.: US 7,719,346 B2
(45) Date of Patent: May 18, 2010

(54) REFERENCE VOLTAGE CIRCUIT

(75) Inventor: Takashi Imura, Chiba (JP)

(73) Assignee: Seiko Instruments Inc. (JP)

( * ) Notice: Subject to any disclaimer, the term of this patent is extended or adjusted under 35 U.S.C. 154(b) by 0 days.

(21) Appl. No.: 12/228,805

(22) Filed: Aug. 15, 2008

(65) Prior Publication Data

US 2009/0045870 A1 Feb. 19, 2009

(30) Foreign Application Priority Data

Aug. 16, 2007 (JP) ..... 2007-212070

(51) Int. Cl.
*G05F 3/02* (2006.01)

(52) U.S. Cl. ..... 327/538; 327/540; 327/541; 327/543

(58) Field of Classification Search ..... None
See application file for complete search history.

(56) References Cited

U.S. PATENT DOCUMENTS 4,996,686 A * 2/1991 Imai et al. ..... 377/60
5,825,695 A * 10/1998 Hamaguchi ..... 365/189.09
6,628,161 B2 * 9/2003 Ikeda ..... 327/538
6,690,229 B2 * 2/2004 Rudolph ..... 327/543
2003/0174014 A1 9/2003 Nakashimo et al. ..... 327/542
2009/0066410 A1 * 3/2009 Shin ..... 327/543

FOREIGN PATENT DOCUMENTS

JP 2003295957 10/2003

* cited by examiner

*Primary Examiner*—Tuan Lam
(74) *Attorney, Agent, or Firm*—Adams & Wilks

(57) ABSTRACT

Provided is a reference voltage circuit whose power supply rejection ratio is large even in a case where a power supply voltage is low. Even in a case where the power supply voltage of a power supply terminal (10) becomes lower and thus an NMOS transistor (71) operates in non-saturation to reduce an output resistance (ro71) of the NMOS transistor (71), when a gain (Ao) of a differential amplifier circuit (60) is large, the power supply rejection ratio ($PSRR_{LF}$) is also large. Therefore, even when a minimum operating voltage of the reference voltage circuit is low, the power supply rejection ratio ($PSRR_{LF}$) can be made larger. In other words, since the gain (Ao) of the differential amplifier circuit (60) contributes to the power supply rejection ratio ($PSRR_{LF}$), when the gain (Ao) of the differential amplifier circuit (60) increases, the power supply rejection ratio ($PSRR_{LF}$) also becomes larger by the increase.

2 Claims, 9 Drawing Sheets

REFERENCE VOLTAGE CIRCUIT

BACKGROUND OF THE INVENTION

1. Field of the Invention

The present invention relates to a reference voltage circuit for generating a constant reference voltage.

2. Description of the Related Art

FIG. 12 shows the conventional ED type reference voltage circuit.

The ED type reference voltage circuit includes a depletion NMOS transistor 84 and an NMOS transistor 85. The gate and source of the depletion NMOS transistor 84 are connected with the reference voltage output terminal 83 and the drain thereof is connected with the power supply terminal 81. The gate and drain of the NMOS transistor 85 are connected with the reference voltage output terminal 83 and the source thereof is connected with the ground terminal 82 (see, for example, JP 04-065546 B (FIG. 2)).

According to the ED type reference voltage circuit, even when a power supply voltage of the power supply terminal 81 varies, a reference voltage of the ED type reference voltage circuit 86 does not easily vary while each of the NMOS transistors operates in saturation.

Assume that a mutual conductance of the NMOS transistor 85 is expressed by gm85 and an output resistance of the depletion NMOS transistor 84 is expressed by ro84. In this case, a power supply rejection ratio (ratio between variation in power supply voltage and variation in reference voltage due to variation in power supply voltage) $PSRR_{LF}$ in the reference voltage output terminal 83 at low frequency is calculated by the following expression.

$$PSRR_{LF}=gm85\times ro84 \quad (2)$$

However, because of, for example, a channel length modulation effect of the depletion NMOS transistor 84, when the power supply voltage of the power supply terminal 81 varies, the reference voltage of the ED type reference voltage circuit 86 also varies. Therefore, the power supply rejection ratio $PSRR_{LF}$ does not become larger.

In order to take measures against such a situation, there is a case where a cascode circuit is added to the power supply terminal 81. FIG. 13 shows a conventional reference voltage circuit.

This reference voltage circuit includes a bias voltage supplying circuit 89, an NMOS transistor 88, and the ED type reference voltage circuit 86. The gate of the NMOS transistor 88 is connected with the bias voltage supplying circuit 89, the source thereof is connected with the ED type reference voltage circuit 86, and the drain thereof is connected with the power supply terminal 87.

According to the reference voltage circuit, even when a power supply voltage of the power supply terminal 87 varies, the reference voltage of the ED type reference voltage circuit 86 does not easily vary because the NMOS transistor 88 operates such that the power supply voltage of the power supply terminal 81 is constant.

Assume that a mutual conductance of the NMOS transistor 88 is expressed by gm88, a substrate bias mutual conductance of the NMOS transistor 88 is expressed by gmb88, and an output resistance of the NMOS transistor 88 is expressed by ro88. In this case, the power supply rejection ratio $PSRR_{LF}$ in the reference voltage output terminal 83 at low frequency is calculated by the following expression.

$$PSRR_{LF}=\{(gm88+gmb88)\times ro88\}\times(gm85\times ro84) \quad (3)$$

In other words, the power supply rejection ratio $PSRR_{LF}$ is multiplied by "(gm88+gmb88)×ro88".

An application example of the reference voltage circuit will be described. FIG. 14 shows an application example of the conventional reference voltage circuit.

This reference voltage circuit includes depletion NMOS transistors 91 to 93, an NMOS transistor 94, the reference voltage output terminal 83, and the ED type reference voltage circuit 86. The gate of the depletion NMOS transistor 91 is connected with the source of the depletion NMOS transistor 92, the source thereof is connected with the ED type reference voltage circuit 86, and the drain thereof is connected with the power supply terminal 87. The gate of the depletion NMOS transistor 92 is connected with the source of the depletion NMOS transistor 91, the source thereof is connected with the drain of the depletion NMOS transistor 93, and the drain thereof is connected with the power supply terminal 87. The gate of the depletion NMOS transistor 93 is connected with the source thereof. The gate of the NMOS transistor 94 is connected with the drain thereof and the source of the depletion NMOS transistor 93. The source of the NMOS transistor 94 is connected with the ground terminal 82 (see, for example, JP 2003-295957 A (FIG. 1)).

According to the reference voltage circuit, even when the power supply voltage of the power supply terminal 87 varies, the reference voltage of the ED type reference voltage circuit 86 does not easily vary because the depletion NMOS transistor 91 operates such that the power supply voltage of the power supply terminal 81 is constant.

When the depletion NMOS transistor 92 operates such that a gate voltage of the depletion NMOS transistor 91 is equal to a source voltage thereof, a mutual conductance of the depletion NMOS transistor 91 does not contribute to the power supply rejection ratio. Therefore, assume that a substrate bias mutual conductance of the depletion NMOS transistor 91 is expressed by gmb91 and an output resistance of the depletion NMOS transistor 91 is expressed by ro91. In this case, the power supply rejection ratio $PSRR_{LF}$ in the reference voltage output terminal 83 at low frequency is calculated by the following expression.

$$PSRR_{LF}=(gmb91\times ro91)\times(gm85\times ro84) \quad (4)$$

In other words, the power supply rejection ratio $PSRR_{LF}$ is multiplied by "gmb91×ro91".

However, when the power supply voltage of the power supply terminal 87 lowers and thus the depletion NMOS transistor 91 operates in non-saturation, the output resistance ro91 of the depletion NMOS transistor 91 becomes smaller to reduce the power supply rejection ratio $PSRR_{LF}$.

SUMMARY OF THE INVENTION

The present invention has been made in view of such a problem. An object of the present invention is to provide a reference voltage circuit in which a power supply rejection ratio is large even when a power supply voltage is low.

In order to solve the above-mentioned problem, the present invention provides A reference voltage circuit for generating a constant reference voltage, comprising: a power supply terminal; a reference voltage output terminal; an ED type reference voltage circuit including a depletion type transistor and an enhancement type transistor for outputting a reference voltage to the reference voltage output terminal; a control transistor for supplying an internal power supply voltage based on a power supply voltage of the power supply terminal to the ED type reference voltage circuit; and a differential amplifier circuit for inputting the reference voltage and the internal power supply voltage, and outputting a control signal to the control transistor, wherein the differential amplifier circuit has an input offset voltage to the reference voltage for operating the depletion type transistor in saturation, and controls the control transistor so that the internal power supply voltage becomes a constant voltage.

Besides, in order to solve the above-mentioned problem, the present invention provides A reference voltage circuit for generating a constant reference voltage, comprising: a power supply terminal; a reference voltage output terminal; a constant voltage circuit including a junction type transistor and a resistor for outputting a reference voltage to the reference voltage output terminal; a control transistor for supplying an internal power supply voltage based on a power supply voltage of the power supply terminal to the constant voltage circuit; and a differential amplifier circuit for inputting the reference voltage and the internal power supply voltage, and outputting a control signal to the control transistor, wherein the differential amplifier circuit has an input offset voltage to the reference voltage for operating the junction type transistor in saturation, and controls the control transistor so that the internal power supply voltage becomes a constant voltage.

According to the present invention, even in a case where the power supply voltage of the power supply terminal becomes lower and thus the control transistor operates in non-saturation, when a gain of the differential amplifier circuit is large, the power supply rejection ratio is also large.

DETAILED DESCRIPTION OF THE PREFERRED EMBODIMENTS

Hereinafter, a concept and embodiments of the present invention will be described with reference to the accompanying drawings.

(Concept)

Figure 1:
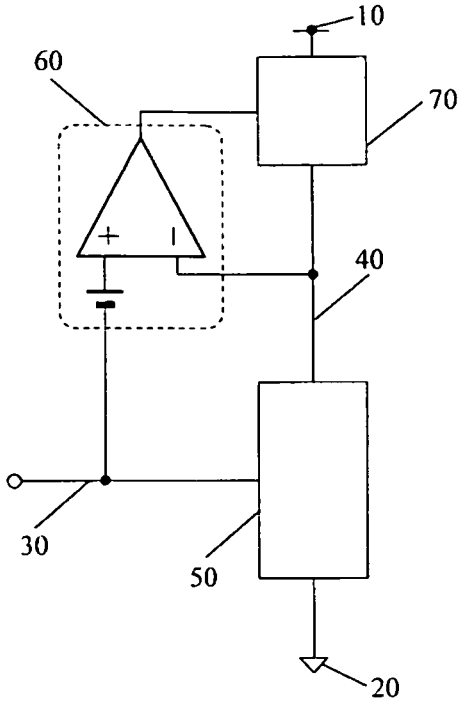
FIG. 1 shows a concept of a reference voltage circuit.

A conceptual structure of a reference voltage circuit for generating a constant reference voltage will be described. FIG. 1 shows the concept of the reference voltage circuit.

The reference voltage circuit of the present invention includes a constant voltage circuit 50, a differential amplifier circuit 60, and a control transistor 70.

The constant voltage circuit 50 includes an input terminal connected with the internal power supply terminal 40 and an output terminal connected with the reference voltage output terminal 30. The differential amplifier circuit 60 includes a non-inverted input terminal connected with the reference voltage output terminal 30, an inverted input terminal connected with the internal power supply terminal 40, and an output terminal connected with an input terminal of the control transistor 70. An output terminal of the control transistor 70 is connected with the internal power supply terminal 40.

The differential amplifier circuit 60 has a predetermined gain and an input offset voltage. The differential amplifier circuit 60 and the control transistor 70 serve as a negative feedback circuit for the internal power supply terminal 40.

Next, a conceptual operation of the reference voltage circuit will be described.

The constant voltage circuit 50 outputs, to the reference voltage output terminal 30, the reference voltage based on the power supply voltage of the internal power supply terminal 40. The differential amplifier circuit 60 outputs a control signal to the control transistor 70 based on the power supply voltage of the internal power supply terminal 40 and the reference voltage of the Constant voltage circuit 50. The control transistor 70 operates in response to the control signal to adjust the power supply voltage of the internal power supply terminal 40 to a constant value.

First Embodiment

Figure 2:
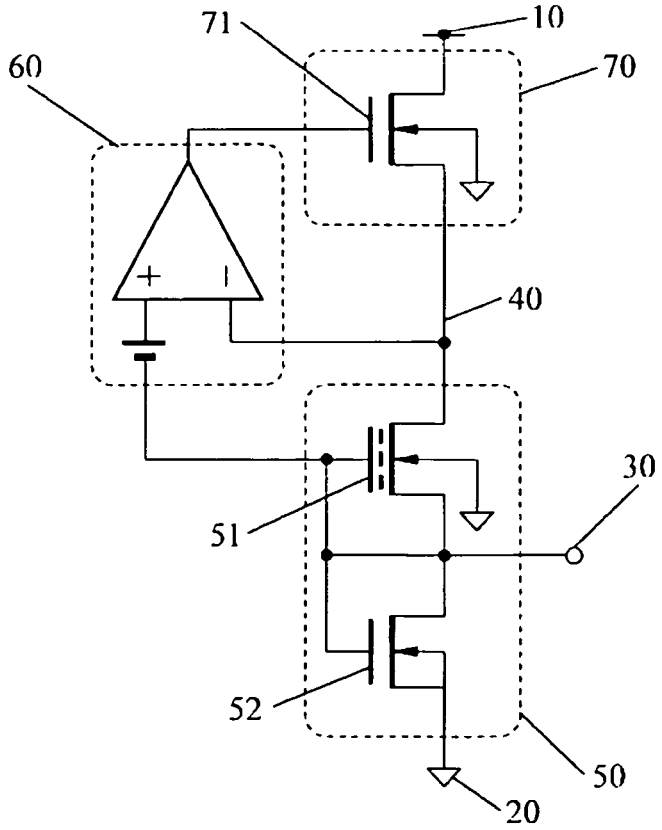
FIG. 2 shows a reference voltage circuit according to a first embodiment of the present invention.

Next, a structure of a reference voltage circuit according to a first embodiment will be described. FIG. 2 shows the reference voltage circuit according to the first embodiment. In the first embodiment, a P-type substrate is used, an NMOS transistor is formed on the P-type substrate, and a PMOS transistor is formed in an N-well provided in the P-type substrate (not shown).

An ED type reference voltage circuit as the constant voltage circuit 50 includes a depletion NMOS transistor 51 and an NMOS transistor 52. The control transistor 70 includes an NMOS transistor 71.

The gate and source of the depletion NMOS transistor 51 are connected with the reference voltage output terminal 30, the drain thereof is connected with the internal power supply terminal 40, and the back gate thereof is connected with the ground terminal 20. The gate and drain of the NMOS transistor 52 are connected with the reference voltage output terminal 30, the source thereof is connected with the ground terminal 20, and the back gate thereof is connected with the ground terminal 20. The gate of the NMOS transistor 71 is connected with the output terminal of the differential amplifier circuit 60, the source thereof is connected with the internal power supply terminal 40, the drain thereof is connected with the power supply terminal 10, and the back gate thereof is connected with the ground terminal 20.

The non-inverted input terminal and inverted input terminal of the differential amplifier circuit 60 are imaginarily short-circuited. The differential amplifier circuit 60 has the predetermined gain and the input offset voltage for operating the depletion NMOS transistor 51 in saturation. Because of the input offset voltage, a source-drain voltage of the depletion NMOS transistor 51 becomes equal to or larger than a saturation voltage at which the depletion NMOS transistor 51 can operate in saturation, and hence, the depletion NMOS transistor 51 operates in saturation. In other words, in view of circuit design, the input offset voltage is set to a value equal to or larger than the saturation voltage. The differential amplifier circuit 60 and the NMOS transistor 71 serve as the negative feedback circuit for the internal power supply terminal 40. Because of the negative feedback circuit, the apparent output resistance of the NMOS transistor 71 increases to a value obtained by being multiplied by the gain of the differential amplifier circuit 60.

Assume that a mutual conductance of the NMOS transistor 71 is expressed by gm71, a substrate bias mutual conductance of the NMOS transistor 71 is expressed by gmb71, the gain of the differential amplifier circuit 60 is expressed by Ao, the output resistance of the NMOS transistor 71 is expressed by ro71, a mutual conductance of the NMOS transistor 52 is expressed by gm52, and an output resistance of the depletion NMOS transistor 51 is expressed by ro51. In this case, the power supply rejection ratio $PSRR_{LF}$ in the reference voltage output terminal 30 at low frequency is calculated by the following expression and becomes larger than a conventional power supply rejection ratio.

$$PSRR_{LF}=[(gm71+gmb71)\times Ao\times ro71]\times(gm52\times ro51) \quad (1)$$

Next, an operation of the reference voltage circuit according to the first embodiment will be described.

When the power supply voltage of the reference voltage circuit is applied to the power supply terminal 10, the power supply voltage of the Constant voltage circuit 50 is generated in the internal power supply terminal 40 to generate the reference voltage in the reference voltage output terminal 30. The power supply voltage of the Constant voltage circuit 50 and the reference voltage of the Constant voltage circuit 50 are input to the differential amplifier circuit 60 to be compared with each other by the differential amplifier circuit 60. The differential amplifier circuit 60 operates such that the power supply voltage of the Constant voltage circuit 50 is equal to a voltage obtained by adding the input offset voltage to the reference voltage of the Constant voltage circuit 50. Therefore, a gate voltage of the NMOS transistor 71 is controlled such that the power supply voltage of the Constant voltage circuit 50 is constant. The NMOS transistor 71 operates to output the constant power supply voltage of the Constant voltage circuit 50 to the internal power supply terminal 40 based on the gate voltage of the NMOS transistor 71 and the power supply voltage of the power supply terminal 10. To be specific, when the power supply voltage of the Constant voltage circuit 50 is higher than the voltage obtained by adding the input offset voltage to the reference voltage of the Constant voltage circuit 50, the voltage of the output terminal of the differential amplifier circuit 60 (gate of NMOS transistor 71) lowers to turn off the NMOS transistor 71, thereby reducing the power supply voltage of the Constant voltage circuit 50. When the power supply voltage of the Constant voltage circuit 50 is lower than the voltage obtained by adding the input offset voltage to the reference voltage of the Constant voltage circuit 50, the power supply voltage of the Constant voltage circuit 50 increases. In other words, the power supply voltage of the Constant voltage circuit 50 is controlled to a constant value. The depletion NMOS transistor 51 operates to flow a constant current into the NMOS transistor 52 based on the power supply voltage of the Constant voltage circuit 50. The NMOS transistor 52 operates to generate the reference voltage which is a constant voltage in the reference voltage output terminal 30.

Figure 7:
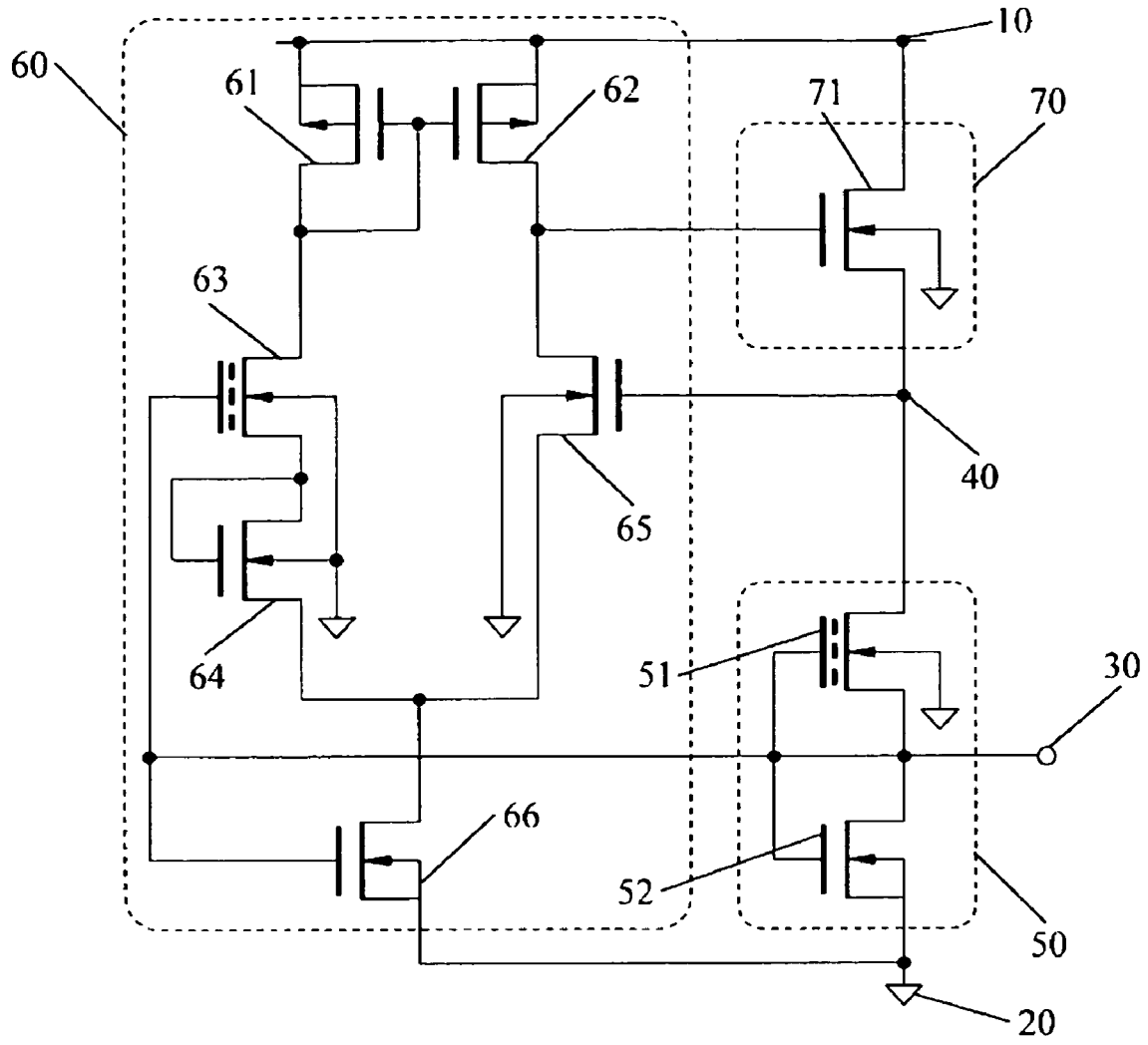
FIG. 7 shows an example of a differential amplifier circuit of the reference voltage circuit of the present invention.

Next, the differential amplifier circuit 60 will be described. FIG. 7 shows the differential amplifier circuit 60.

An input terminal of a current mirror circuit including PMOS transistors 61 and 62 is connected with the drain of a depletion NMOS transistor 63 and an output terminal thereof is connected with the drain of an NMOS transistor 65. The gate of the depletion NMOS transistor 63 is connected with the non-inverted input terminal of the differential amplifier circuit 60 and the gate of an NMOS transistor 66. The source of the depletion NMOS transistor 63 is connected with the drain of an NMOS transistor 64. The back gate of the depletion NMOS transistor 63 is connected with the ground terminal 20. The gate of the NMOS transistor 64 is connected with the drain thereof and the source thereof is connected with the drain of the NMOS transistor 66. The back gate of the NMOS transistor 64 is connected with the ground terminal 20. The gate of the NMOS transistor 65 is connected with the inverted input terminal of the differential amplifier circuit 60 and the source thereof is connected with the drain of the NMOS transistor 66. The back gate of the NMOS transistor 65 is connected with the ground terminal 20. The source and back gate of the NMOS transistor 66 are connected with the ground terminal 20. The gate of the depletion NMOS transistor 63 corresponds to the non-inverted input terminal of the differential amplifier circuit 60. The gate of the NMOS transistor 65 corresponds to the inverted input terminal of the differential amplifier circuit 60. The output terminal of the current mirror circuit corresponds to the output terminal of the differential amplifier circuit 60.

The NMOS transistor 66 operates as a constant current circuit for maintaining a constant sum of a current flowing into the depletion NMOS transistor 63 and a current flowing into the NMOS transistor 65. A threshold voltage between the non-inverted input terminal and the drain of the NMOS transistor 66 is a sum of a threshold voltage of the depletion NMOS transistor 63 and a threshold voltage of the NMOS transistor 64. A threshold voltage between the inverted input terminal and the drain of the NMOS transistor 66 is a threshold voltage of the NMOS transistor 65. In this case, when the NMOS transistor 64 and the NMOS transistor 65 have the same drive capability, the differential amplifier circuit 60 has a positive input offset voltage based on an absolute value of the threshold voltage of the depletion NMOS transistor 63 at the non-inverted input terminal because the threshold voltage of the depletion NMOS transistor 63 is negative. When the NMOS transistor 64 and the NMOS transistor 65 have different drive capabilities from each other, the positive input offset voltage is adjusted by a difference therebetween. The reference voltage output terminal 30 is connected with the gate of the NMOS transistor 66, and hence, a current based on a current flowing through the Constant voltage circuit 50 flows into the NMOS transistor 66.

In such a case, as is apparent from Expression (1), the mutual conductance gm71 of the NMOS transistor 71, the substrate bias mutual conductance gmb71 of the NMOS transistor 71, the gain Ao of the differential amplifier circuit 60, and the output resistance ro71 of the NMOS transistor 71 contribute to the power supply rejection ratio $PSRR_{LF}$. Therefore, the power supply rejection ratio $PSRR_{LF}$ becomes larger by the contribution.

Even in a case where the power supply voltage of the power supply terminal 10 becomes lower and thus the NMOS transistor 71 operates in non-saturation to reduce the output resistance ro71 of the NMOS transistor 71, when the gain Ao of the differential amplifier circuit 60 is large, the power supply rejection ratio $PSRR_{LF}$ is also large. Therefore, even when a minimum operating voltage of the reference voltage circuit is low, the power supply rejection ratio $PSRR_{LF}$ can be made larger. In other words, since the gain Ao of the differential amplifier circuit 60 contributes to the power supply rejection ratio $PSRR_{LF}$, when the gain Ao of the differential amplifier circuit 60 increases, the power supply rejection ratio $PSRR_{LF}$ also becomes larger by the increase.

The reference voltage of the Constant voltage circuit 50 is not determined only based on a voltage applied from the outside and the threshold voltages of the MOS transistors. Since the negative feedback circuit is used, the power supply voltage of the Constant voltage circuit 50 is determined based on the power supply voltage and the reference voltage of the Constant voltage circuit 50, and the reference voltage of the Constant voltage circuit 50 is determined based on the determined power supply voltage. Therefore, the reference voltage of the Constant voltage circuit 50 is adjusted for determination and thus not easily affected by a variation in threshold voltage of the depletion NMOS transistor 51 and a variation in threshold voltage of the NMOS transistor 52 in the Constant voltage circuit 50.

The NMOS transistor 71 is used, but a PMOS transistor (not shown) of a grounded-source circuit may also be used. In this case, a connection point of the non-inverted input terminal of the differential amplifier circuit 60 and a connection point of the inverted input terminal thereof are interchanged to negatively feed back to the internal power supply terminal 40.

The example of the circuit structure of the Constant voltage circuit 50 has been described. The circuit structure disclosed in JP 04-065546 B (not shown) may be employed. In this case, the power supply voltage of the Constant voltage circuit 50 and the reference voltage thereof are input to the differential amplifier circuit 60. The differential amplifier circuit 60 operates such that the power supply voltage of the Constant voltage circuit 50 is equal to the voltage obtained by adding the input offset voltage to the reference voltage of the Constant voltage circuit 50.

In FIG. 7, a MOS transistor whose gate portion includes a broken line corresponds to a depletion MOS transistor, and a MOS transistor whose gate portion includes no broken line corresponds to an enhancement MOS transistor.

The gate of the NMOS transistor 66 may be connected with the ground terminal 20 and a depletion NMOS transistor (not shown) may be used instead of the NMOS transistor 66.

Figure 8:
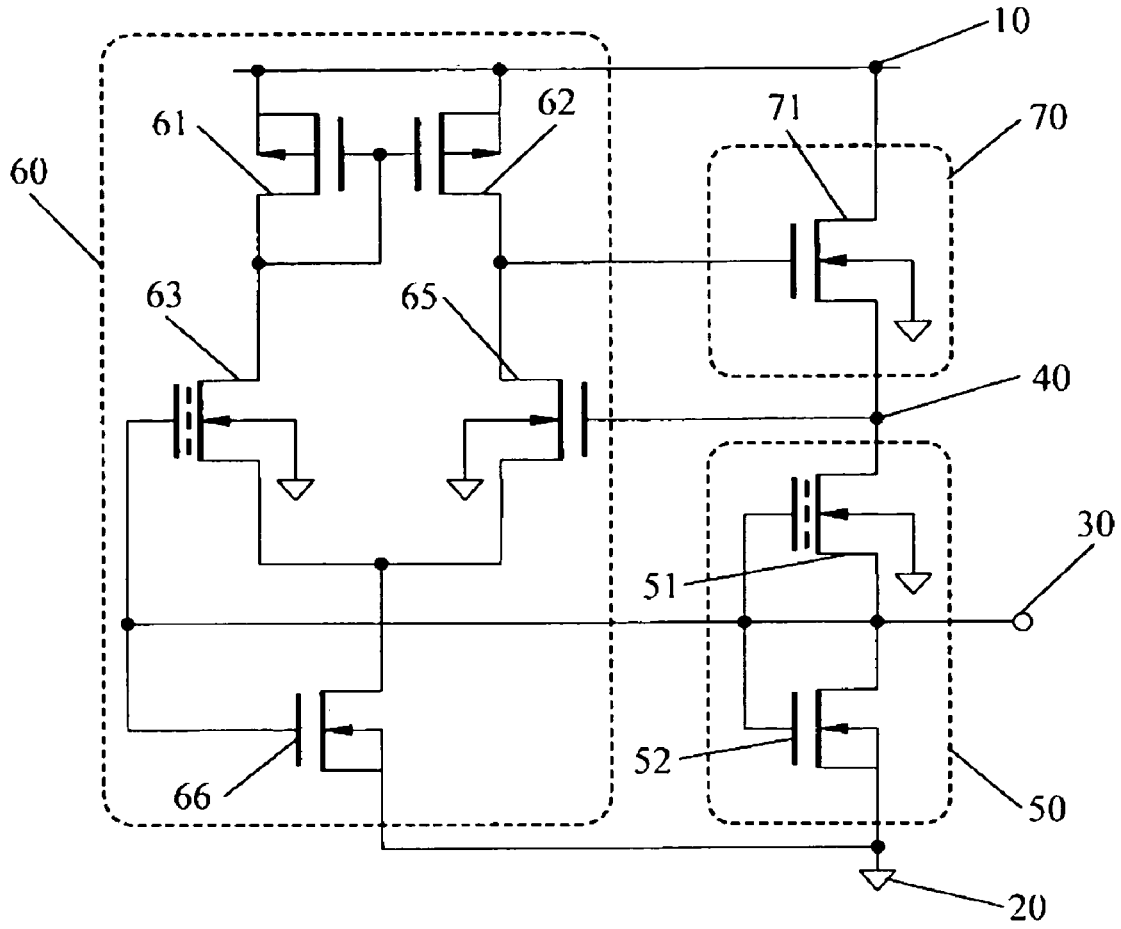
FIG. 8 shows another example of the differential amplifier circuit of the reference voltage circuit of the present invention.

The internal circuit structure of the differential amplifier circuit 60 may be modified. FIG. 8 shows another example of the differential amplifier circuit 60.

When the differential amplifier circuit 60 shown in FIG. 8 is compared with the differential amplifier circuit 60 shown in FIG. 7, the NMOS transistor 64 is omitted.

The NMOS transistor 66 operates as the constant current circuit for maintaining a constant sum of a current flowing into the depletion NMOS transistor 63 and a current flowing into the NMOS transistor 65. The threshold voltage between the non-inverted input terminal and the drain of the NMOS transistor 66 is the threshold voltage of the depletion NMOS transistor 63. The threshold voltage between the inverted input terminal and the drain of the NMOS transistor 66 is the threshold voltage of the NMOS transistor 65. In this case, since the threshold voltage of the depletion NMOS transistor 63 is negative, the differential amplifier circuit 60 has a positive input offset voltage based on an absolute value of a difference voltage between the threshold voltage of the depletion NMOS transistor 63 and the threshold voltage of the NMOS transistor 65 at the non-inverted input terminal.

Figure 9:
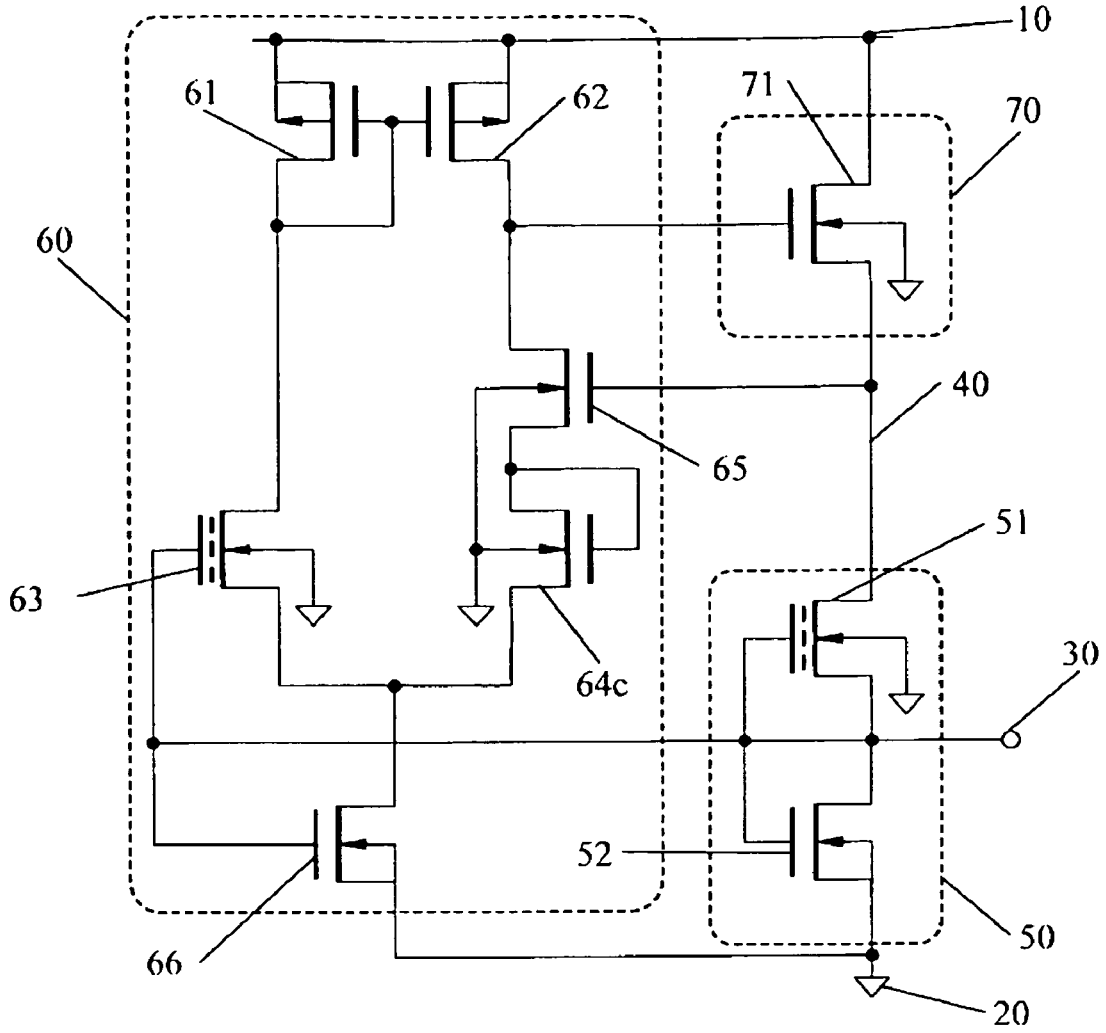
FIG. 9 shows another example of the differential amplifier circuit of the reference voltage circuit of the present invention.

The internal circuit structure of the differential amplifier circuit 60 may be modified. FIG. 9 shows another example of the differential amplifier circuit 60.

When the differential amplifier circuit 60 shown in FIG. 9 is compared with the differential amplifier circuit 60 shown in FIG. 8, an NMOS transistor 64*c* is added.

The NMOS transistor 66 operates as the constant current circuit for maintaining a constant sum of a current flowing into the depletion NMOS transistor 63 and a current flowing into the NMOS transistor 65. The threshold voltage between the non-inverted input terminal and the drain of the NMOS transistor 66 is the threshold voltage of the depletion NMOS transistor 63. The threshold voltage between the inverted input terminal and the drain of the NMOS transistor 66 is a sum of the threshold voltage of the NMOS transistor 65 and the threshold voltage of the NMOS transistor 64*c*. In this case, since the threshold voltage of the depletion NMOS transistor 63 is negative, the differential amplifier circuit 60 has a positive input offset voltage based on an absolute value of a difference voltage between the threshold voltage of the depletion NMOS transistor 63 and the voltage of the above-mentioned sum at the non-inverted input terminal.

Figure 10:
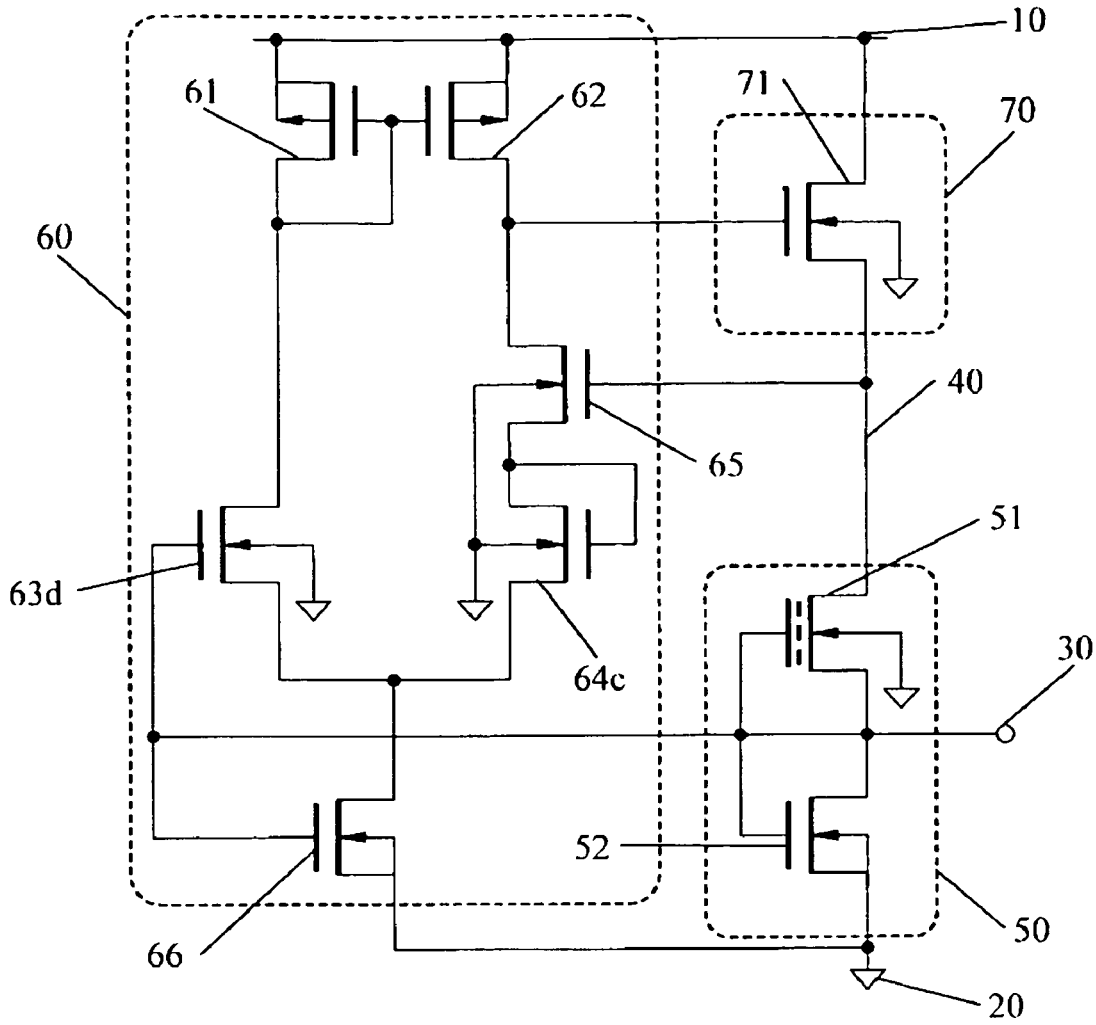
FIG. 10 shows another example of the differential amplifier circuit of the reference voltage circuit of the present invention.

The internal circuit structure of the differential amplifier circuit 60 may be modified. FIG. 10 shows another example of the differential amplifier circuit 60.

When the differential amplifier circuit 60 shown in FIG. 10 is compared with the differential amplifier circuit 60 shown in FIG. 9, the depletion NMOS transistor 63 is changed to an NMOS transistor 63*d*.

The NMOS transistor 66 operates as the constant current circuit for maintaining a constant sum of a current flowing into the NMOS transistor 63*d* and a current flowing into the NMOS transistor 65. The threshold voltage between the non-inverted input terminal and the drain of the NMOS transistor 66 is the threshold voltage of the NMOS transistor 63*d*. The threshold voltage between the inverted input terminal and the drain of the NMOS transistor 66 is a sum of the threshold voltage of the NMOS transistor 65 and the threshold voltage of the NMOS transistor 64*c*. In this case, the differential amplifier circuit 60 has a positive input offset voltage based on an absolute value of a difference voltage between the threshold voltage of the NMOS transistor 63*d* and the voltage of the above-mentioned sum at the non-inverted input terminal.

Figure 11:
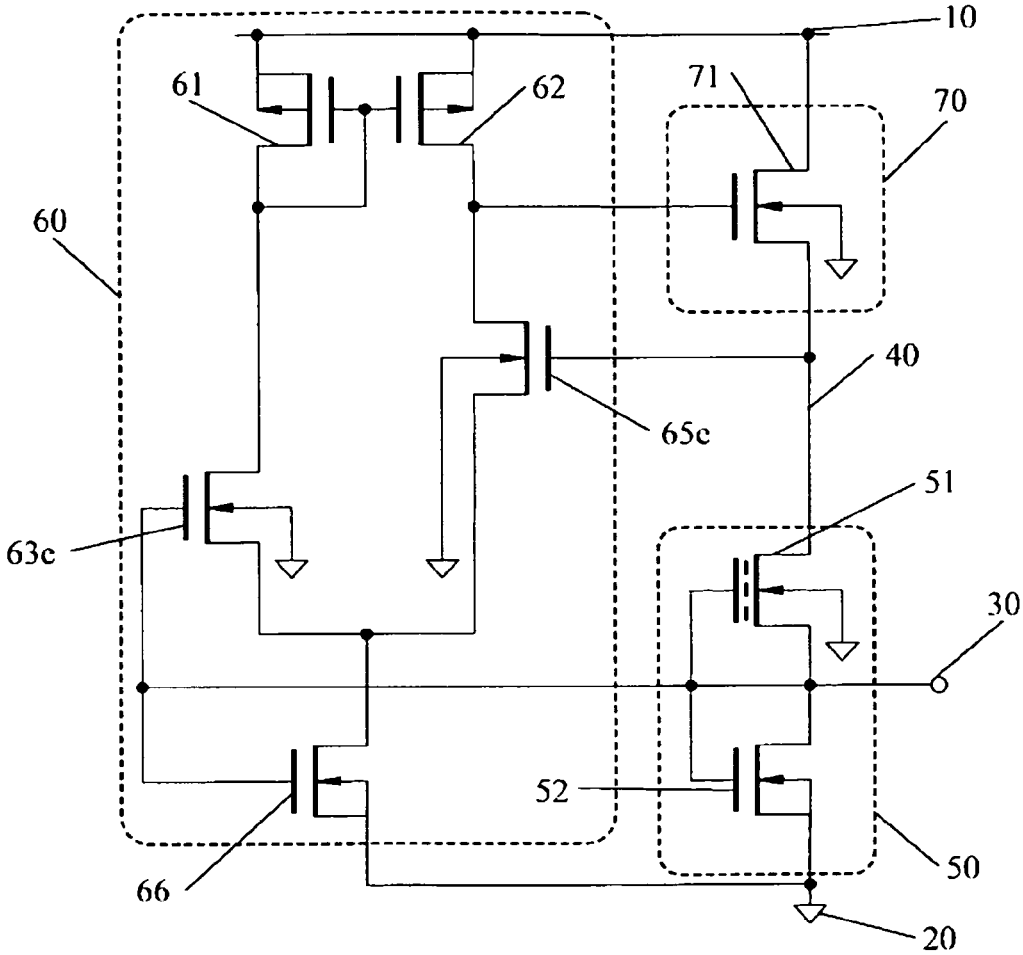
FIG. 11 shows another example of the differential amplifier circuit of the reference voltage circuit of the present invention.
Figure 12:
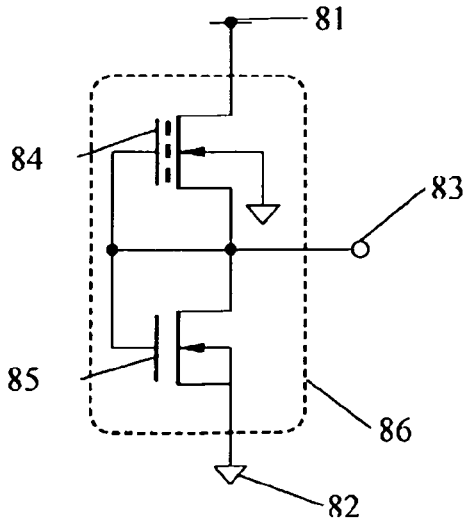
FIG. 12 shows a conventional reference voltage circuit.
Figure 13:
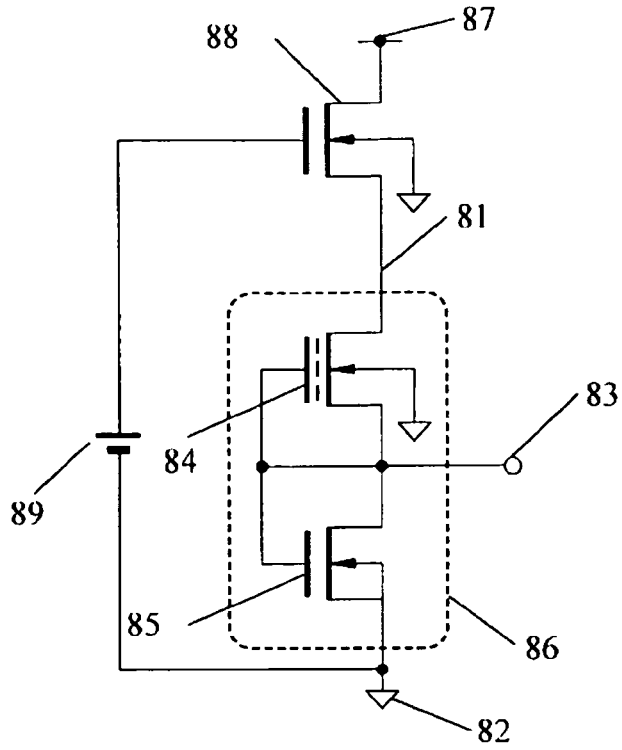
FIG. 13 shows a conventional reference voltage circuit.
Figure 14:
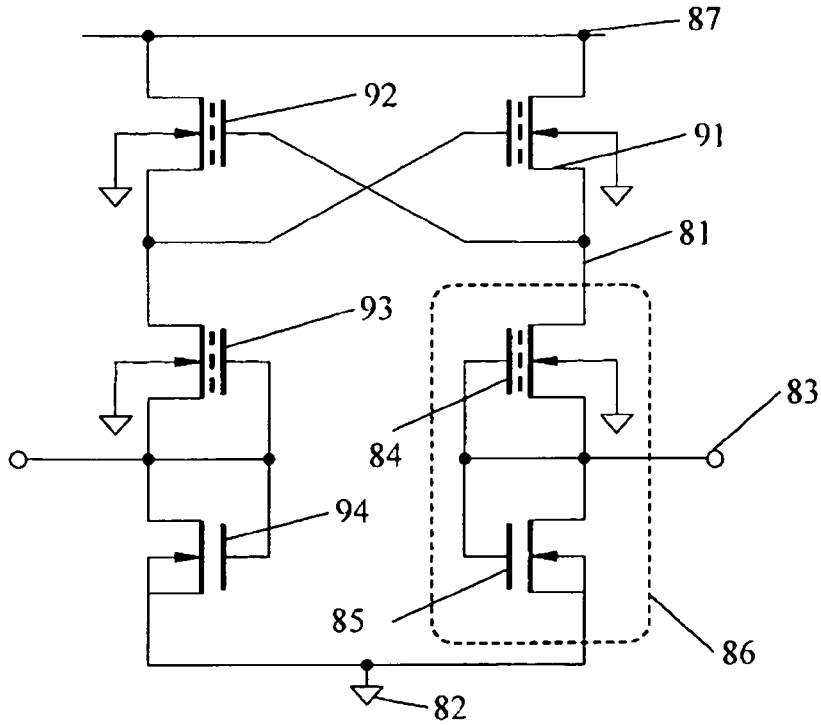
FIG. 14 shows a conventional reference voltage circuit.

The internal circuit structure of the differential amplifier circuit 60 may be modified. FIG. 11 shows another example of the differential amplifier circuit 60.

When the differential amplifier circuit 60 shown in FIG. 11 is compared with the differential amplifier circuit 60 shown in FIG. 10, the NMOS transistor 63*d* is changed to an NMOS transistor 63*e*, the NMOS transistor 65 is changed to an NMOS transistor 65*e*, and the NMOS transistor 64*c* is omitted. An actual or apparent threshold voltage of the NMOS transistor 65*e* is higher than a threshold voltage of the NMOS transistor 63*e*. For example, when the back gate of the NMOS transistor 63*e* is connected with the source thereof, the back gate of the NMOS transistor 65*e* is connected with the ground terminal 20, and a back gate voltage of the NMOS transistor 65*e* is set to a value lower than a back gate voltage of the NMOS transistor 63*e* (not shown), the threshold voltage of the NMOS transistor 65*e* can be increased higher than the threshold voltage of the NMOS transistor 63*e*. When the channel doping amounts for the NMOS transistors 63*e* and 65*e* are changed (not shown), the threshold voltage of the NMOS transistor 65*e* can be increased higher than the threshold voltage of the NMOS transistor 63*e*. When a mutual conductance coefficient of the NMOS transistor 63*e* is set to a value larger than a mutual conductance coefficient of the NMOS transistor 65*e* and/or a mutual conductance coefficient of the PMOS transistor 61 is set to a value larger than a mutual conductance coefficient of the PMOS transistor 62, and a driving current of the NMOS transistor 63*e* is set to a value larger than a driving current of the NMOS transistor 65*e* (not shown), the apparent threshold voltage of the NMOS transistor 65*e* can be increased higher than the threshold voltage of the NMOS transistor 63*e*.

The NMOS transistor 66 operates as the constant current circuit for maintaining a constant sum of a current flowing into the NMOS transistor 63*e* and a current flowing into the NMOS transistor 65*e*. The threshold voltage between the non-inverted input terminal and the drain of the NMOS transistor 66 is the threshold voltage of the NMOS transistor 63*e*. The threshold voltage between the inverted input terminal and the drain of the NMOS transistor 66 is the threshold voltage of the NMOS transistor 65*e*. In this case, the differential amplifier circuit 60 has a positive input offset voltage based on an absolute value of a difference voltage between the threshold voltage of the NMOS transistor 63*e* and the threshold voltage of the NMOS transistor 65*e* at the non-inverted input terminal.

Second Embodiment

Figure 3:
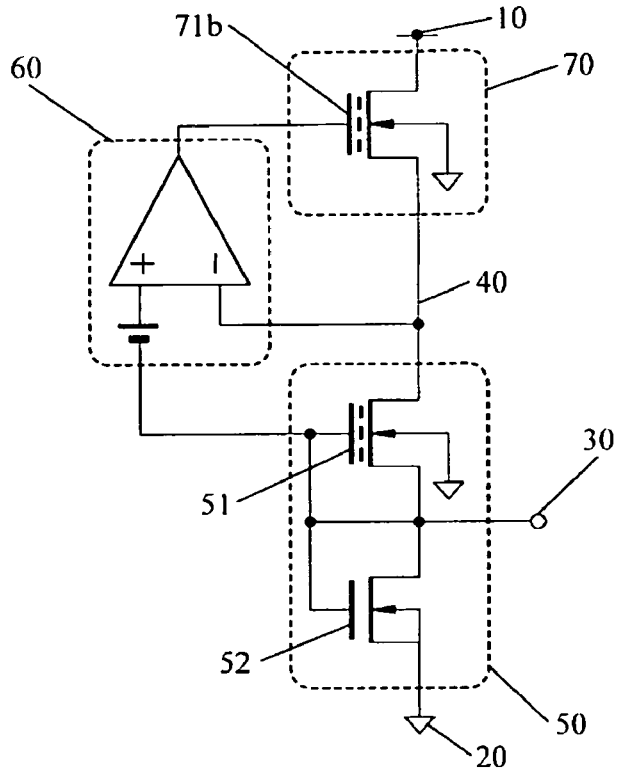
FIG. 3 shows a reference voltage circuit according to a second embodiment of the present invention.

Next, a structure of a reference voltage circuit according to a second embodiment will be described. FIG. 3 shows the reference voltage circuit according to the second embodiment. In the second embodiment, a P-type substrate is used, an NMOS transistor is formed on the P-type substrate, and a PMOS transistor is formed in an N-well provided in the P-type substrate (not shown).

An ED type reference voltage circuit as the constant voltage circuit 50 is the same circuit as in the first embodiment. The control transistor 70 includes a depletion NMOS transistor 71*b*.

The gate of the depletion NMOS transistor 71*b* is connected with the output terminal of the differential amplifier circuit 60, the source thereof is connected with the internal power supply terminal 40, the drain thereof is connected with the power supply terminal 10, and the back gate thereof is connected with the ground terminal 20.

Third Embodiment

Figure 4:
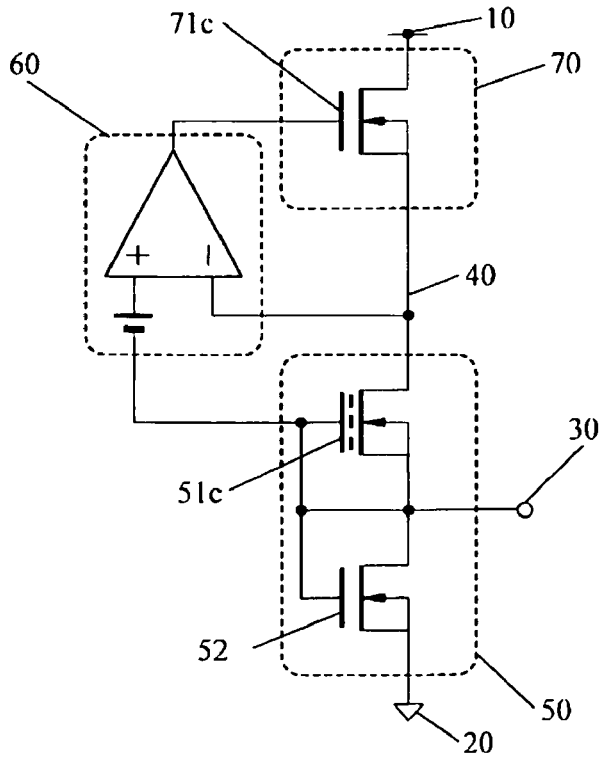
FIG. 4 shows a reference voltage circuit according to a third embodiment of the present invention.

Next, a structure of a reference voltage circuit according to a third embodiment will be described. FIG. 4 shows the reference voltage circuit according to the third embodiment. In the third embodiment, an N-type substrate is used, a PMOS transistor is formed on the N-type substrate, and an NMOS transistor is formed in a P-well provided in the N-type substrate (not shown).

An ED type reference voltage circuit as the constant voltage circuit 50 includes a depletion NMOS transistor 51*c* and the NMOS transistor 52. The control transistor 70 includes an NMOS transistor 71*c*.

The gate, source and back gate of the depletion NMOS transistor 51*c* are connected with the reference voltage output terminal 30, the drain thereof is connected with the internal power supply terminal 40. The gate of the NMOS transistor 71*c* is connected with the output terminal of the differential amplifier circuit 60, the source and back gate thereof are connected with the internal power supply terminal 40, and the drain thereof is connected with the power supply terminal 10.

Fourth Embodiment

Figure 5:
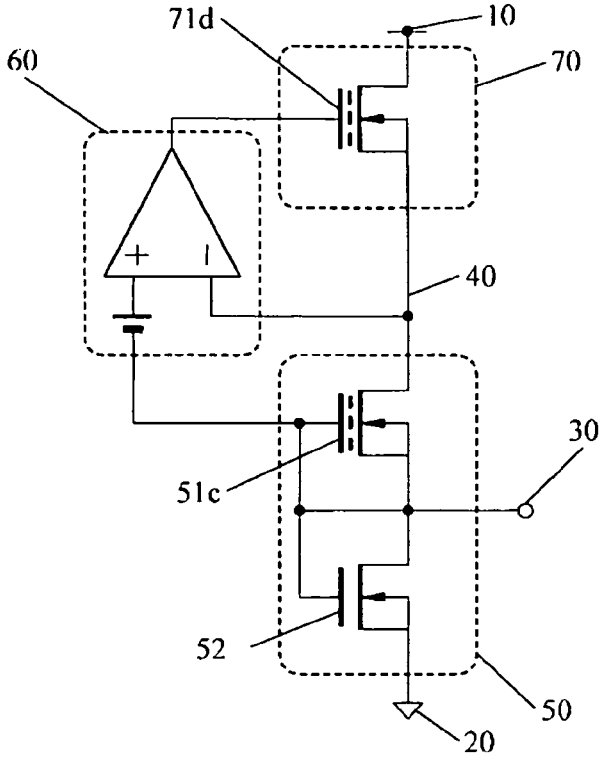
FIG. 5 shows a reference voltage circuit according to a fourth embodiment of the present invention.

Next, a structure of a reference voltage circuit according to a fourth embodiment will be described. FIG. 5 shows the reference voltage circuit according to the fourth embodiment. In the fourth embodiment, an N-type substrate is used, a PMOS transistor is formed on the N-type substrate, and an NMOS transistor is formed in a P-well provided in the N-type substrate (not shown).

An ED type reference voltage circuit as the constant voltage circuit 50 is the same circuit as in the third embodiment. The control transistor 70 includes a depletion NMOS transistor 71*d*.

The gate of the depletion NMOS transistor 71*d* is connected with the output terminal of the differential amplifier circuit 60, the source and back gate thereof are connected with the internal power supply terminal 40, and the drain thereof is connected with the power supply terminal 10.

Fifth Embodiment

Figure 6:
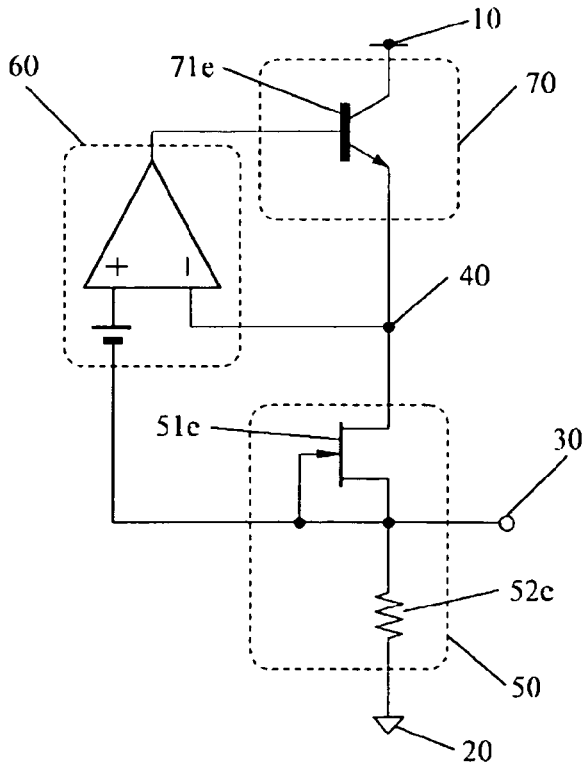
FIG. 6 shows a reference voltage circuit according to a fifth embodiment of the present invention.

Next, a structure of a reference voltage circuit according to a fifth embodiment will be described. FIG. 6 shows the reference voltage circuit according to the fifth embodiment.

The Constant voltage circuit 50 includes a junction NMOS transistor 51*e* and a resistor 52*e*. The control transistor 70 includes an NPN transistor 71*e*.

The gate and source of the junction NMOS transistor 51*e* are connected with the reference voltage output terminal 30 and the drain thereof is connected with the internal power supply terminal 40. One end of the resistor 52*e* is connected with the reference voltage output terminal 30 and the other end thereof is connected with the ground terminal 20. The base of the NPN transistor 71*e* is connected with the output terminal of the differential amplifier circuit 60, the emitter thereof is connected with the internal power supply terminal 40, and the collector thereof is connected with the power supply terminal 10.

The NPN transistor 71*e* is used, but a PNP transistor (not shown) may also be used. In this case, the connection point of the non-inverted input terminal of the differential amplifier circuit 60 and the connection point of the inverted input terminal thereof are interchanged to negatively feed back to the internal power supply terminal 40.

What is claimed is:

1. A reference voltage circuit for generating a constant reference voltage, comprising:

a power supply terminal;

a reference voltage output terminal;

an ED type reference voltage circuit including a depletion type transistor and an enhancement type transistor for outputting a reference voltage to the reference voltage output terminal;

a control transistor for supplying an internal power supply voltage based on a power supply voltage of the power supply terminal to the ED type reference voltage circuit; and a differential amplifier circuit to which are input the reference voltage and the internal power supply voltage, and which outputs a control signal to the control transistor, wherein the differential amplifier circuit adds an input offset voltage to the reference voltage for operating the depletion type transistor in saturation, and controls the control transistor so that the internal power supply voltage becomes a constant voltage.

2. A reference voltage circuit according to claim 1, wherein the differential amplifier circuit and the control transistor serve as a negative feedback circuit for the internal power supply terminal.

* * * * *